US010638577B1

(12) United States Patent
Sun et al.

(10) Patent No.: US 10,638,577 B1
(45) Date of Patent: Apr. 28, 2020

(54) DIMMER FOR USE WITH A LIGHT SOURCE

(71) Applicant: Dialog Semiconductor (UK) Limited, London (GB)

(72) Inventors: Junyue Sun, Tianjin (CN); Xiaogang Zhao, Beijing (CN); Nailong Wang, Beijing (CN); Zhenyu Song, Beijing (CN); Libo Zhou, Beijing (CN)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 16/666,748

(22) Filed: Oct. 29, 2019

(30) Foreign Application Priority Data

Aug. 6, 2019 (GB) ..... 1911264.8

(51) Int. Cl.
*H05B 33/08* (2020.01)
*H05B 45/10* (2020.01)
*H05B 45/37* (2020.01)

(52) U.S. Cl.
CPC ..... *H05B 45/10* (2020.01); *H05B 45/37* (2020.01)

(58) Field of Classification Search
CPC ..... H05B 33/08; H05B 33/0815; H05B 33/0845; H05B 33/0884; H05B 45/00; H05B 45/10; H05B 45/37
See application file for complete search history.

(56) References Cited

U.S. PATENT DOCUMENTS 7,999,484 B2 * 8/2011 Jurngwirth ..... H05B 33/0851 315/185 S
8,294,375 B2 * 10/2012 Lee ..... H05B 33/0815 315/185 R
8,766,546 B2 * 7/2014 Oshima ..... H05B 33/0887 315/185 R
8,907,584 B2 * 12/2014 Lim ..... H05B 33/0827 315/247
2014/0097755 A1 * 4/2014 Lee ..... H05B 33/083 315/122
2017/0290118 A1 * 10/2017 Takagimoto ..... B60Q 1/1415

OTHER PUBLICATIONS

Co-pending U.S. Appl. No. 16/185,126, filed Nov. 9, 2018, by Nailong Wang et al., "A Pulse Width Modulation Circuit," 35 pages.

* cited by examiner

*Primary Examiner* — Thai Pham
(74) *Attorney, Agent, or Firm* — Saile Ackerman LLC; Stephen B. Ackerman

(57) ABSTRACT

A dimmer for dimming light emitted by a light source is presented. The dimmer includes a regulation switch for regulating a current flowing through the light source and a regulator circuit that provides an electronic parameter to control the regulation switch. The regulator circuit has a dimmer switch for passing or blocking the electronic parameter, and a signal generator generating a plurality of modulated signals configured to operate the regulator circuit in a first phase and in a second phase. In the first phase the regulation circuit maintains the electronic parameter to a target value. In the second phase the regulation circuit monitors a variation of the electronic parameter and maintains the electronic parameter to a predetermined value.

18 Claims, 8 Drawing Sheets

DIMMER FOR USE WITH A LIGHT SOURCE

TECHNICAL FIELD

The present disclosure relates to a dimmer for dimming light emitted by a light source. In particular, the present disclosure relates to a dimmer regulated by a pulse-width modulated signal without turn-on delay.

BACKGROUND

Many applications require varying the light intensity of a semiconductor light source such as a light-emitting diode (LED). For instance displays based on LED back-lighting technology require many LED zones to achieve a high contrast ratio between bright and dark images. Each LED zone also referred to as LED channel can be used to achieve local dimming and create realistic images.

Dimming may be achieved using a pulse width modulated PWM signal to drive a dimming transistor. The pulse width modulated signal is repeatedly switched between high and low states. Upon receiving a high state at its gate, the dimming transistor couples the light source to a current source, and the light source emits light. Upon receiving a low state at its gate, the dimming transistor decouples the light source from the current source and the light source stops emitting light. Therefore the dimming effect is achieved by enabling and disabling of the dimming transistor repeatedly at a sufficiently high frequency, while the level of dimming is changed by changing the duty cycle of the PWM signal.

Traditionally, the frequency of the PWM signal ranges between 50 Hz and 960 HZ. However, better dimming performances can be achieved at higher frequencies. For instance above 20 KHz audio noise can be greatly reduced or eliminated. At such high frequencies the turn-on delay of the PWM signal affects the dimming accuracy and linearity. Existing solutions based on the measurement of the turn-on delay and subsequent delay compensation lack reliability especially when the PWM signal is set with a high duty cycle.

SUMMARY

It is an object of the disclosure to address one or more of the above-mentioned limitations.

According to a first aspect of the disclosure, there is provided a dimmer for dimming light emitted by a light source, the dimmer comprising a regulation switch for regulating a current flowing through the light source, a regulator circuit adapted to provide an electronic parameter to control the regulation switch, where the regulator circuit comprises a dimmer switch for passing or blocking the electronic parameter, and a signal generator adapted to generate a plurality of modulated signals configured to operate the regulator circuit in a first phase and in a second phase, where in the first phase the regulation circuit maintains the electronic parameter to a target value, and where in the second phase the regulation circuit monitors a variation of the electronic parameter and maintains the electronic parameter to a predetermined value.

For instance the light source may be a semiconductor light source such as an LED. The regulation switch may be a power switch such as a power FET transistor.

For example the dimmer switch may be a single-pole double-throw switch. The signal generator may be a PWM generator for providing a PWM signal.

Optionally, the electronic parameter is a voltage.

Optionally, the predetermined value is a positive voltage that is less or equal to the threshold voltage of the regulation switch.

Optionally, the plurality of modulated signals comprises a first logic signal having a first duty cycle and a second logic signal having a second duty cycle.

Optionally, when the first logic signal and the second logic signal are both in a high state, the regulation circuit operates in the first phase.

Optionally, when the first logic signal is in a high state, and the second logic signal is in a low state the regulation circuit operates in the second phase.

Optionally, when the first logic signal and the second logic signal are both in a low state, the regulation circuit operates in a third phase in which no current flows through the light source.

Optionally, when the second duty cycle is greater than a first threshold value, the regulation circuit is adapted to monitor a decrease of the electronic parameter upon transition of the second logic signal from the high state to the low state, and when the electronic parameter has decreased to the pre-determined value, to maintain the electronic parameter at the pre-determined value until the second logic signal turns to the high state.

For instance the first threshold value may be 50% duty cycle or a value greater than 50% for instance 90% duty cycle.

Optionally, when the second duty cycle is less than a second threshold value, the regulation circuit is adapted to increase the electronic parameter to the pre-determined value while the second logic signal is in the low state, and to maintain the electronic parameter at the pre-determined value until the second logic signal turns to the high state.

For instance the second threshold value may be 50% duty cycle or a value less than 50% for instance 10% duty cycle.

Optionally, the electronic parameter is increased at a set time during the low state of the second logic signal.

Optionally, the regulator circuit comprises a differential amplifier coupled to the regulator switch via the dimmer switch.

Optionally, the regulator circuit comprises a first sensor coupled to a control terminal of the regulation switch and a second sensor adapted to sense a current through the light source.

Optionally, the differential amplifier has a first input adapted to receive a reference parameter, and a second input selectively coupled either to the first sensor via a first path or to the second sensor via a second path. For example, the reference parameter may be a target current.

Optionally, the second input is selectively coupled to the first and the second paths via a feedback switch. For instance the feedback switch may be a single-pole double-throw switch.

Optionally, the dimmer switch is adapted to receive the second logic signal and the feedback switch is adapted to receive both the first logic signal and the second logic signal.

According to a second aspect of the disclosure, there is provided a method of dimming light emitted by a light source, the method comprising providing a regulation switch for regulating a current flowing through the light source, providing a regulator circuit adapted to provide an electronic parameter to control the regulation switch, where the regulator circuit comprises a dimmer switch for passing or blocking the electronic parameter, and generating a plurality of modulated signals configured to operate the regulator circuit in a first phase and in a second phase, where in the first phase the regulation circuit maintains the electronic parameter to a target value, and where in the second phase the regulation circuit monitors a variation of the electronic parameter and maintains the electronic parameter to a predetermined value.

Optionally, the predetermined value is less than the target value.

Optionally, the predetermined value is a positive voltage that is less or equal to the threshold voltage of the regulation switch.

The options described with respect to the first aspect of the disclosure are also common to the second aspect of the disclosure.

BRIEF DESCRIPTION OF THE DRAWINGS

The disclosure is described in further detail below by way of example and with reference to the accompanying drawings, in which.

DETAILED DESCRIPTION

Figure 1:
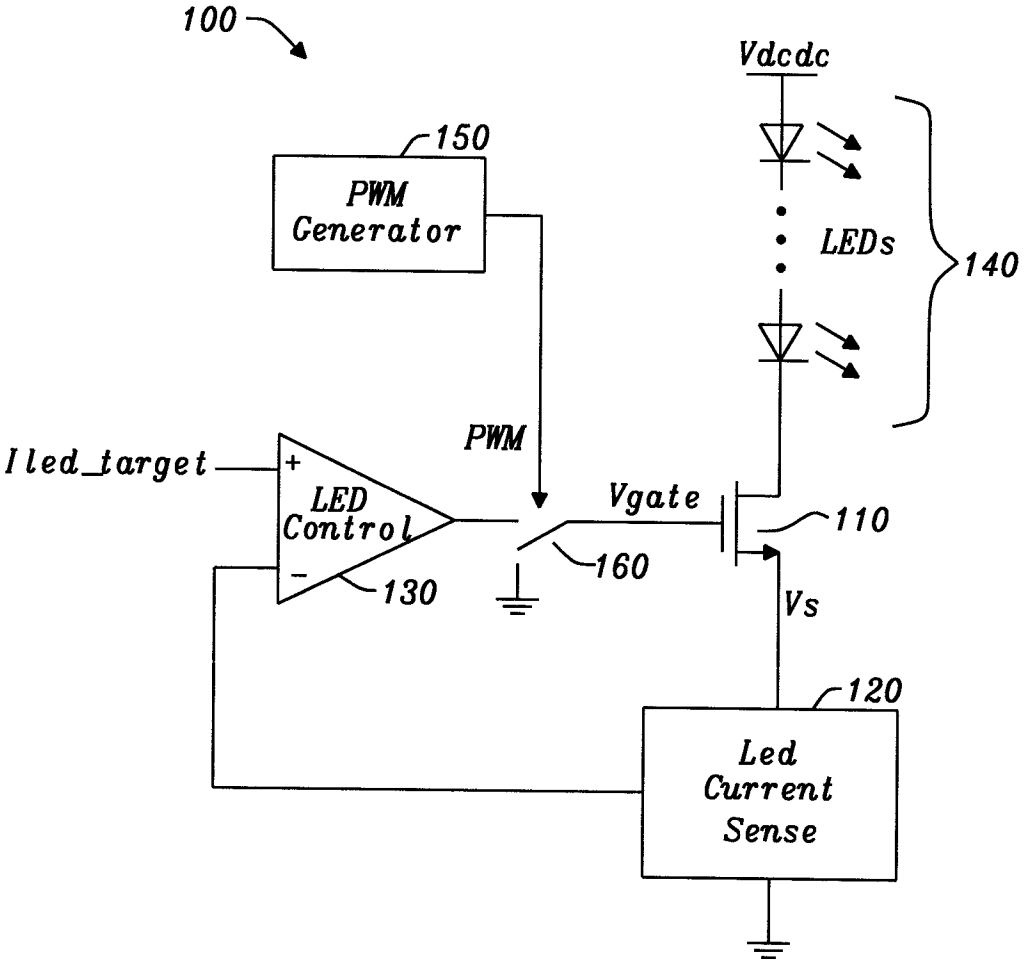
FIG. 1 Prior Art
FIG. 1 is a diagram of a conventional PWM based dimmer circuit.

FIG. 1 illustrates a conventional pulse width modulation PWM dimmer circuit 100 for dimming light from a string of light emitting diodes LEDs 140, of the prior art. The PWM dimmer includes a transistor 110, a current sensor 120 such as a resistor, a differential amplifier 130 such as an operational amplifier, a PWM generator 150, and a PWM switch also referred to as dimmer switch 160. The string of LEDs is connected at one end to DC-DC voltage source and at another to a first terminal of the transistor 110. In this example the transistor 110 is an N-type MSOFET having a drain terminal connected to the string of LEDs 140, a source terminal connected to the current sensor 120 and a gate terminal for receiving a gate voltage Vgate from the differential amplifier 130. The differential amplifier 130 has an inverting input connected to the output of the current sensor 120, and a non-inverting input for receiving a target current reference. The output of the differential amplifier 130 is coupled to the gate terminal of transistor 110 via the PWM switch 160. The PWM switch 160 is a single-pole double-throw SPDT switch.

In operation, the differential amplifier 130 provides a gate voltage proportional to the difference between the LED current sensed by sensor 120 and the target current. When the gate voltage is above the threshold voltage Vth of the transistor 110, a current Iled passes through the string of LEDs 140 which emits light. The current sensor 120 acts as both a current sensor and a current source.

The PWM generator 150 is used to dim the light emitted by the LED string 140. The PWM generator 150 provides a PWM signal that control the state open or closed of the PWM switch 160. When the PWM switch 160 is closed the gate voltage is applied to the transistor 110 and when the PWM switch is open the gate voltage is not applied to the transistor 110. Stated another way, when the PWM signal is high (for example logic 1), the gate terminal of transistor 110 is controlled by the differential amplifier 130, and when the PWM signal is low (for example logic 0), the gate terminal is pulled down to ground. However, the gate voltage is not applied instantly to the gate terminal. Instead the gate voltage is applied after a certain delay time.

Figure 2:
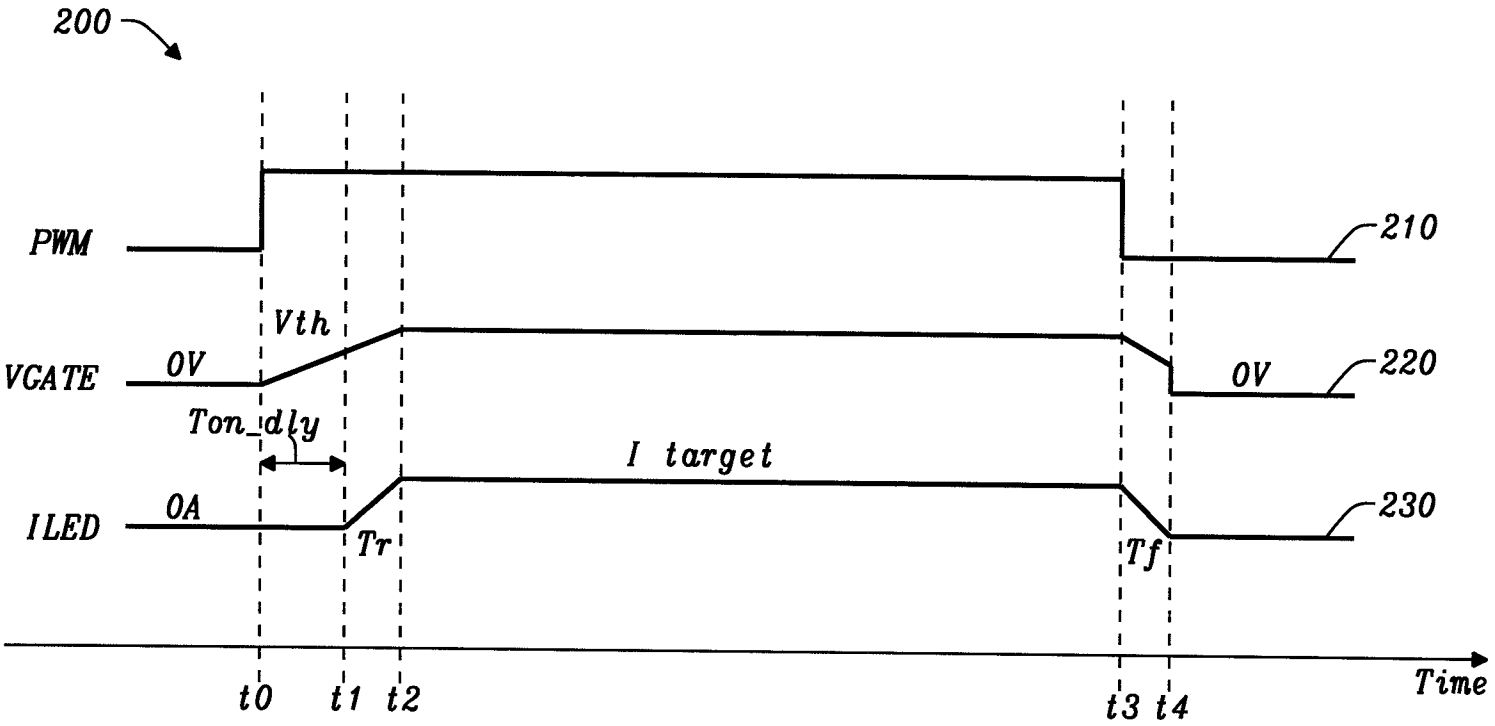
FIG. 2 is waveform diagram illustrating the working of the circuit of FIG. 1.

FIG. 2 illustrates 200, the PWM signal 210 provided by the PWM generator 150, the gate voltage 220 provided by the differential amplifier 130 and the LED current 230 flowing through the transistor 110 as a function of time.

Before a time t0, the PWM signal is in a low state, and both the gate voltage 220 and the LED current 230 are null. At time t0 the PWM signal transits from the logic low to a logic high state. The gate voltage 220 starts increasing linearly. At time t1, the gate voltage reaches the threshold voltage Vth of the transistor 110 and the LED current 230 starts increasing. At time t2 the gate voltage reaches the value set by the differential amplifier 130 and the LED current 230 reach the target value I_target. The time difference between the times t0 and t1 defines the PWM turn-on delay, Ton_dly.

At time t3 the PWM signal 210 transits from the logic high to the logic low state. The gate voltage 220 starts decreasing linearly concomitantly with the LED current 230. At time t4, the gate voltage 220 falls below the threshold voltage Vth of the transistor 110 and the LED current 230 drops to zero.

The PWM turn-on delay Ton_dly changes depending on process corner, voltage and temperature variations, PVT. For instance Ton_dly may vary by +/−50%~100% hence greatly reducing the accuracy of the dimming function.

The traditional PWM dimming frequency ranges between about 50 Hz-960 Hz. Within this frequency range the turn-on delay is not a critical factor of current accuracy and linearity. However, there are advantages in using a higher PWM dimming frequency. For instance applying a PWM frequency greater than 20 KHz may be used to avoid audio-noise. In this case, the turn-on delay and the rising/falling time of the PWM signal become important factors for the accuracy and linearity of the dimming function.

Figure 3:
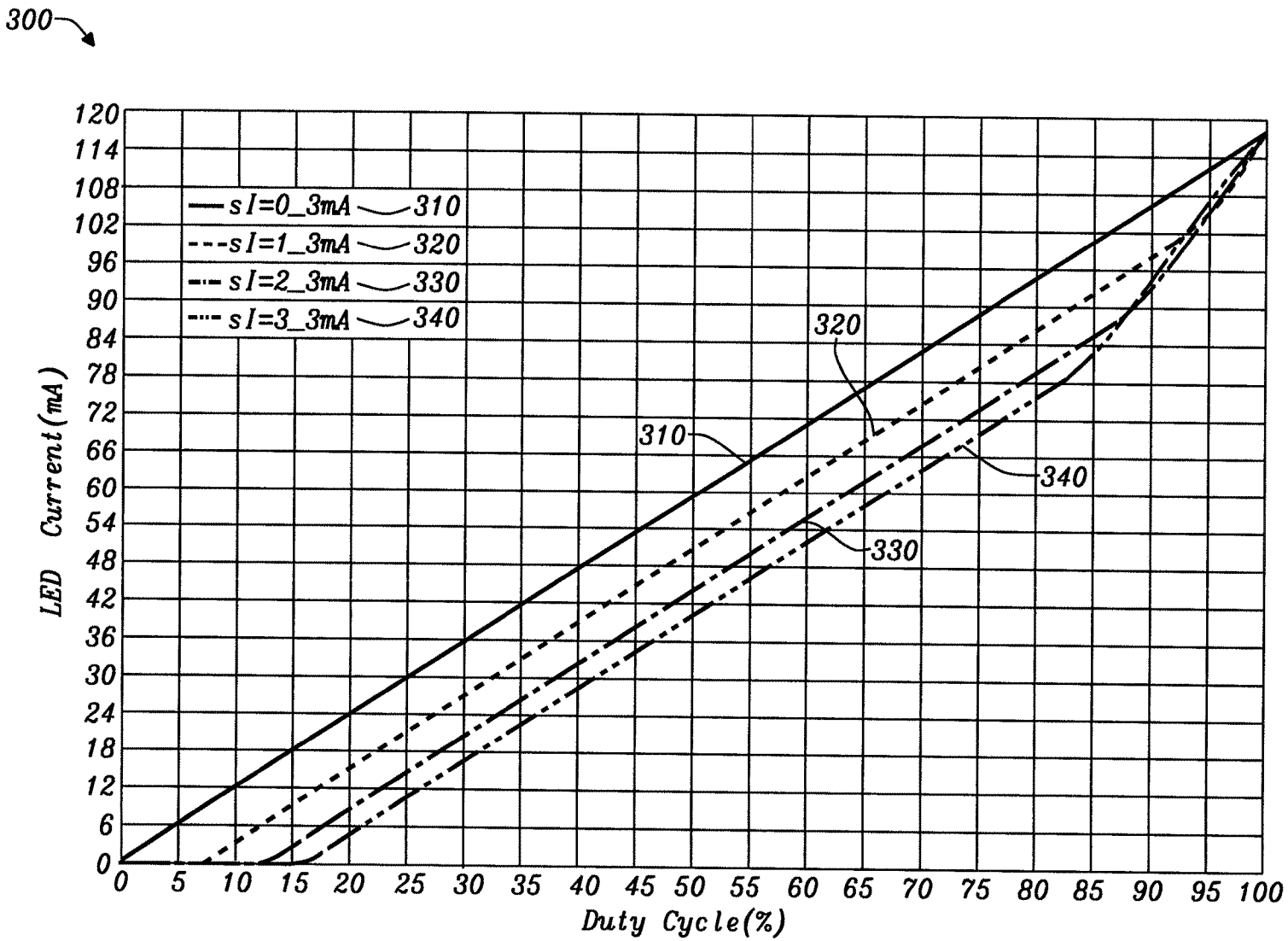
FIG. 3 is a plot illustrating the LED current as a function of PWM duty cycle obtained for different turn-on delays in the circuit of FIG. 1.

FIG. 3 illustrates 300, the LED current as a function of PWM duty cycle obtained for different turn-on delays in the circuit of FIG. 1. Various plots are shown for different combinations of PWM turn-on delays and rising/falling times. The plot 310 corresponds to a turn_on_delay of 50 ns and a rising/falling time of 50 ns. The plot 320 corresponds to a turn_on_delay of 100 ns and a rising/falling time=100 ns. The plot 330 corresponds to a turn_on_delay of 200 ns and a rising/falling time of 200 ns. The plot 340 corresponds to a turn_on_delay of 300 ns and a rising/falling time of 300 ns.

The shorter the turn-on delay and the faster the rising/falling time, the better the accuracy and linearity of the plot. However in order to provide such short delays and fast rising/falling times, the transistor 110 needs to be driven with a relatively large driver with high power dissipation. This increases the cost of manufacturing and limits the applications of such systems.

Figure 4:
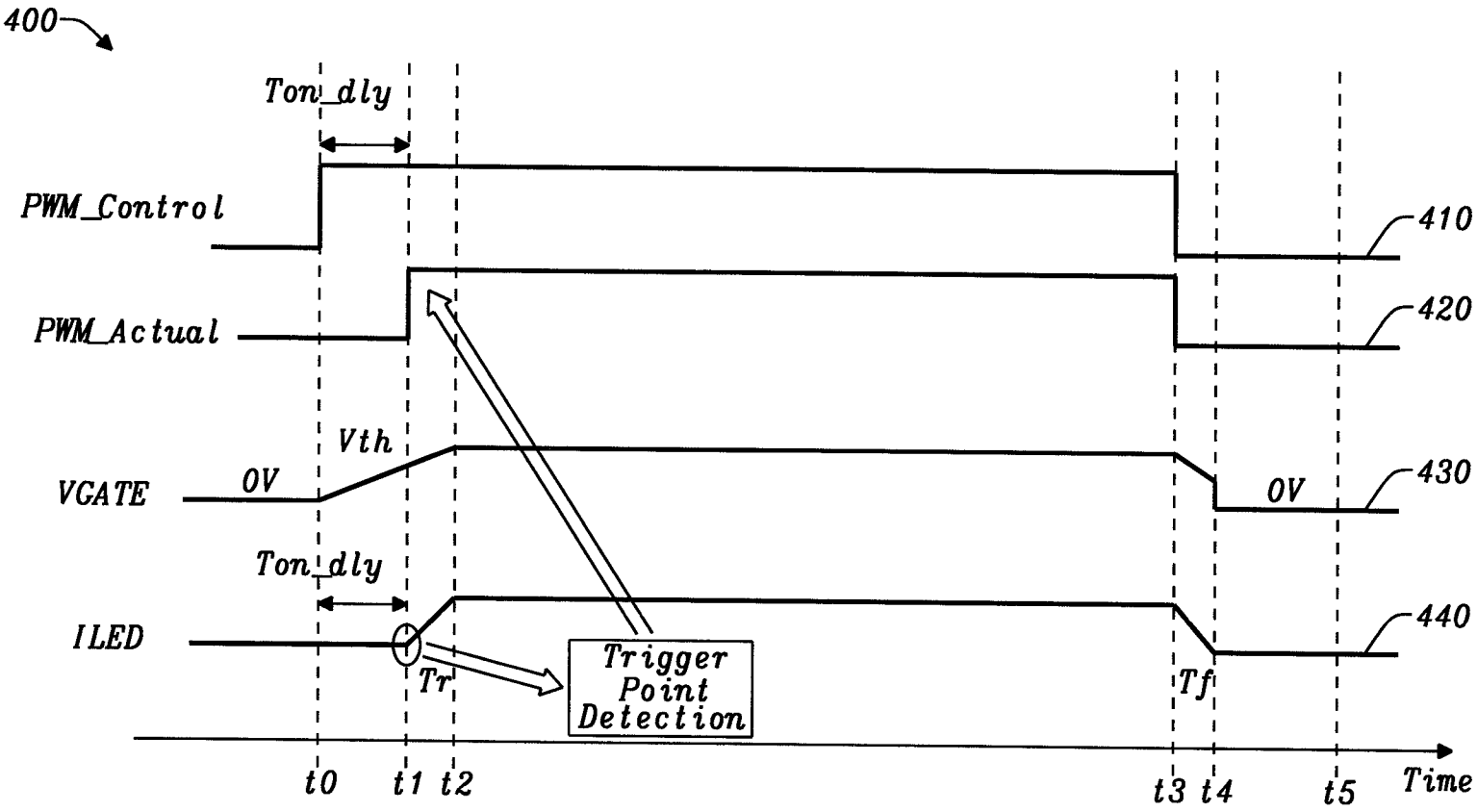
FIG. 4 is waveform diagram illustrating a conventional PWM delay compensation method.

FIG. 4 is 400, a waveform diagram illustrating a conventional method for compensating the PWM turn on delay described above. FIG. 4 shows a PWM control signal labelled PWM_Control 410 for changing the state of the switch 160, an indictor signal or flag referred to as PWM_Actual 420, the gate voltage VGATE 430 and the LED current ILED 440 as a function of time.

At time t0 the PWM_Control signal 410 transits from a logic low to a logic high. The gate voltage starts rising to reach the threshold voltage Vth of the regulation transistor at time t1. At this so-called trigger point the gate to source voltage Vgs of the regulation transistor is greater than Vth and the LED current ILED 440 starts increasing from OA. A current detector detects ILED and the flag signal PWM_Actual 420 changes from a low state (logic 0) to a high state (logic 1), hence indicating when the current ILED becomes positive. This is then used to adjust the duty cycle of the PWM_Control signal 410 by extending it by the Ton_dly value. However this technique is not suitable when the PWM pulse width is set close to the PWM period, as it does not provide enough time t0 turn-on delay compensation. In addition, the turn on delay is not easily measured.

Figure 5:
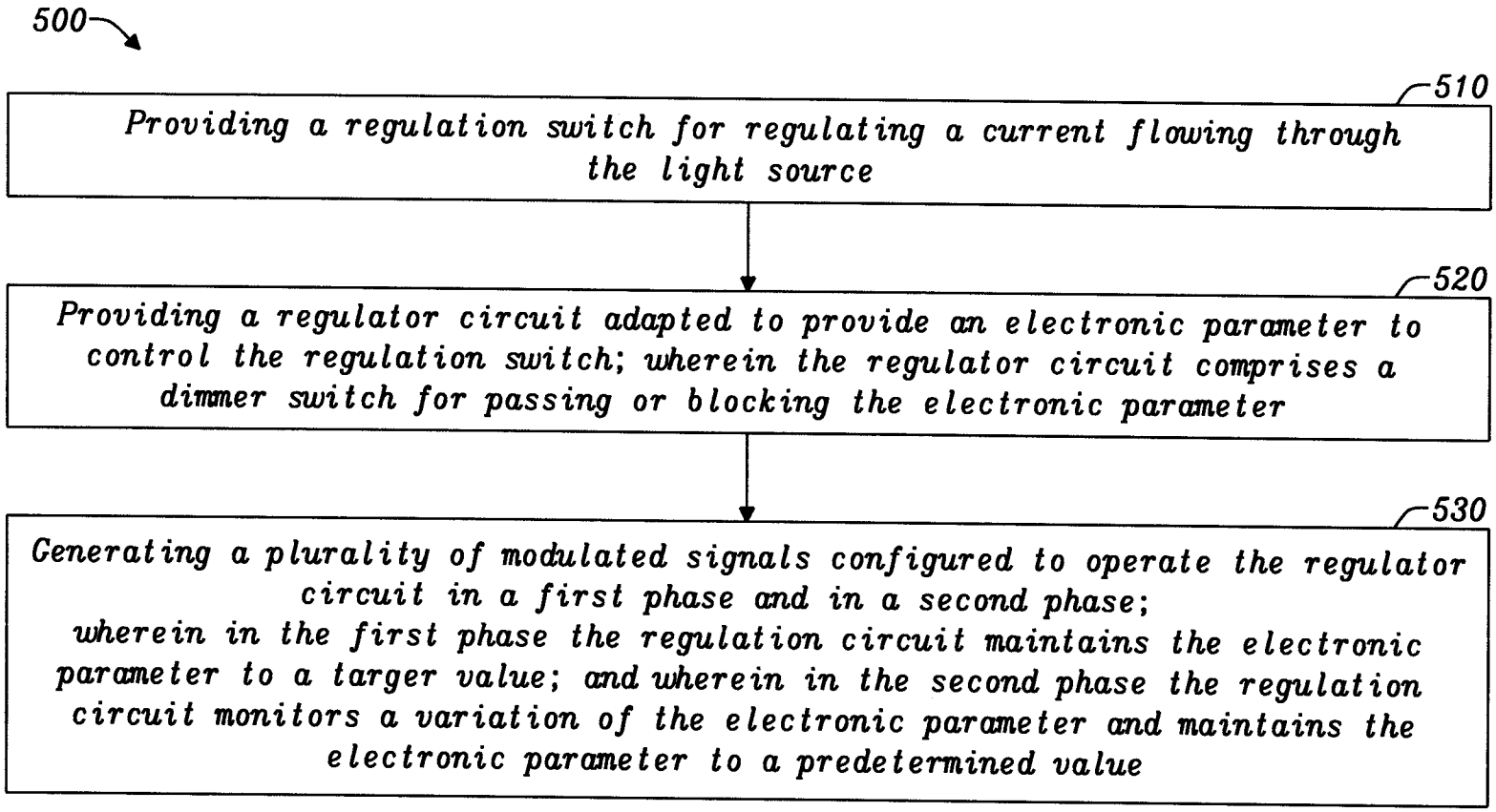
FIG. 5 is a flow chart of a dimming method according to the disclosure.

FIG. 5 is 500, a flow chart of a method for dimming light emitted by light source according to the disclosure. For instance the light source may be a semiconductor light source such as an LED device formed of one or more LEDs.

At step 510 a regulation switch for regulating a current flowing through the light source is provided.

At step 520 a regulator circuit is provided. The regulator circuit is adapted to provide an electronic parameter to control the regulation switch. The regulator circuit also includes a dimmer switch for passing or blocking the electronic parameter.

For instance the electronic parameter may be a voltage to be provided at a control terminal of the regulation switch.

At step 530 a plurality of modulated signals is generated. The modulated signals are configured to operate the regulator circuit in a first phase and in a second phase. In the first phase the regulation circuit maintains the electronic parameter to a target value. In the second phase the regulation circuit monitors a variation of the electronic parameter and maintains the electronic parameter to a predetermined value.

For instance the electronic parameter may be a voltage to be provided at a control terminal of the regulation switch, and the predetermined value may be a positive voltage that is less than the threshold voltage of the regulation switch. The predetermined value may be chosen to be as close as possible to the threshold voltage.

The plurality of modulated signals may include a first logic signal having a first duty cycle for controlling the dimmer switch and a second logic signal having a second duty cycle for controlling, together with the first logic signal, a feedback switch of the regulation circuit.

By passing or blocking the electronic parameter using the dimmer switch, a level of brightness of the light source can be adjusted.

For applications requiring a high brightness level (low level of dimming), the duty cycle of the second logic signal is set relatively high, for instance greater than 50%, or greater than 70%, or greater than 90%. For applications requiring a low brightness level (high level of dimming), the duty cycle of the second logic signal is set relatively low, for instance less than 50% or less than 30% or less than 10%.

When the duty cycle of the second logic signal is set relatively high for instance above 50%, the electronic parameter decreases when the second logic signal turns low. The electronic parameter is sensed and when the electronic parameter has decreased to the pre-determined value, it is maintained to the pre-determined value until the second logic signal turns high. Therefore, for high brightness applications (low level dimming) the method may be referred to as discharging-holding method.

When the duty cycle of the second logic signal is set relatively low for instance below 50%, the electronic parameter is increased up to the predetermined value at some point during the off state of the second logic signal. The electronic parameter is then maintained at the pre-determined value until the second logic signal turns to the on state. Therefore, for low brightness applications (high level dimming) the method may be referred to as pre-charging-holding method.

Using the proposed method, the PWM turn-on delay is eliminated. By removing the PWM turn-on delay, the time between the PWM control signal and the light source current is reduced. As a result the current flowing through the light source can be turn on and off faster, hence improving dimming control and accuracy.

Figure 6:
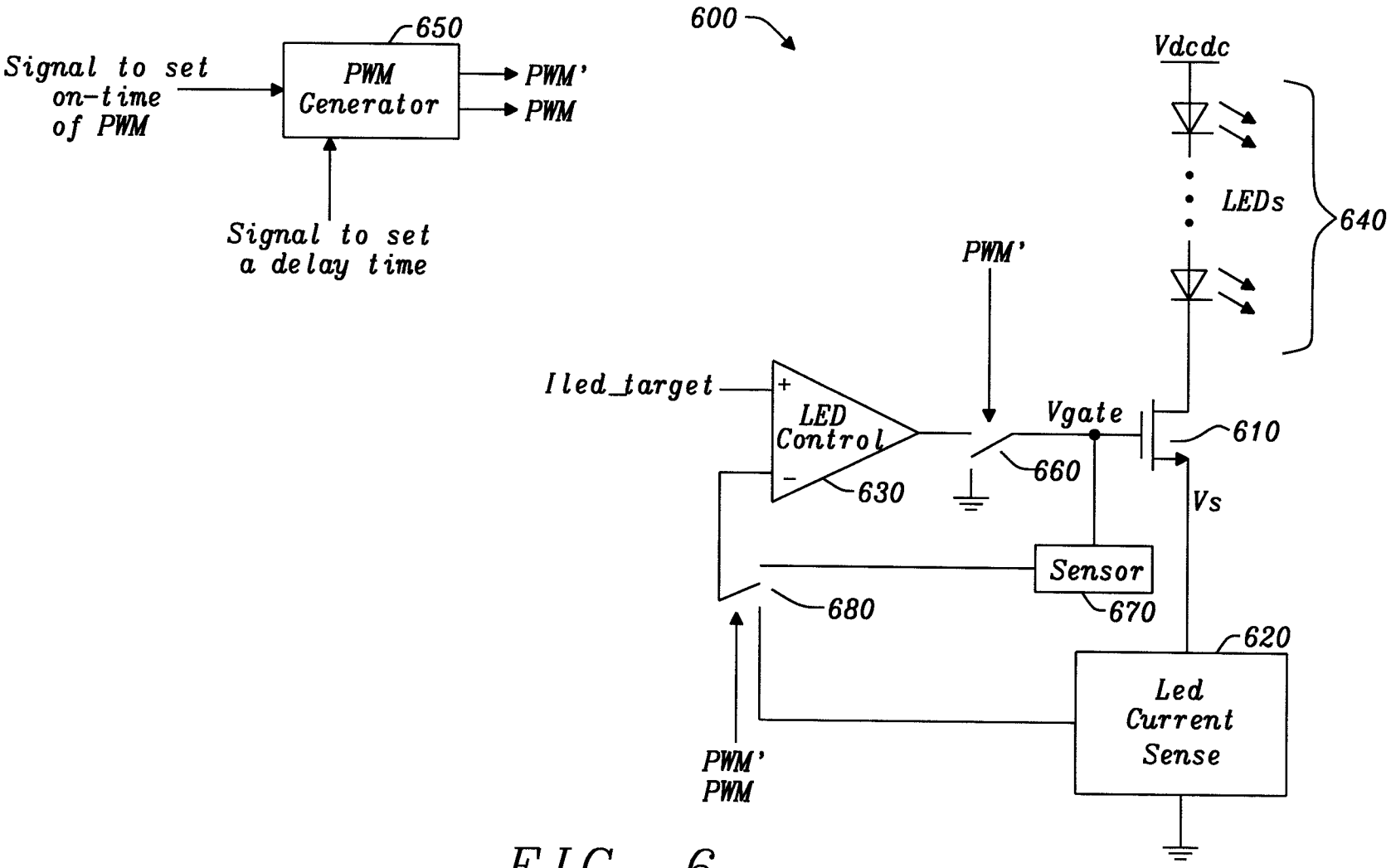
FIG. 6 is a diagram of a dimmer circuit for implementing the method according to FIG. 5.

FIG. 6 is 600, a diagram of a dimmer circuit for implementing the method of FIG. 5. The dimmer circuit 600 includes a first switch 610 also referred to as regulation switch coupled to a regulation circuit. The regulation circuit includes a current sensor 620 such as a resistor or a current mirror circuit, a differential amplifier 630 such as an operational amplifier, a PWM generator 650, a second switch also referred to as PWM dimmer switch 660, a voltage sensor 670 and a third switch also referred to as feedback switch 680.

A string of LEDs 640 has a first terminal coupled to a voltage supply for receiving a voltage Vdcdc and a second terminal coupled to the current sensor 620 via the transistor 610. In this example the first switch 610 is an N-type MSOFET having a drain terminal coupled to the second terminal of the string of LEDs 640, a source terminal coupled to the current sensor 620 and a gate terminal for receiving a gate voltage Vgate from the differential amplifier 630. The voltage sensor 670 has an input coupled to the gate terminal of the transistor 610 and an output coupled to the inverting input of the differential amplifier 630. The voltage sensor 670 may be implemented in different ways, for instance the voltage sensor may be a resistor divider or a voltage buffer. The differential amplifier 630 has a first input for instance a non-inverting input, for receiving a target current Iled_target and a second input, for instance an inverting input, coupled either to the voltage sensor 670 or to the current sensor 620 depending on the state of the feedback switch 680.

The output of the differential amplifier 630 is coupled to the gate terminal of transistor 610 via the PWM dimmer switch 660. The PWM dimmer switch 660 may be a single-pole double-throw SPDT switch, the single-pole being connected to the gate terminal of the transistor 610 and the double-through being connected to the output of the differential amplifier 630 and to ground respectively. The feedback switch 680 may also be SPDT switch, the single-pole being connected to the inverting input of the differential amplifier 630 and the double-through being connected to the output of the voltage sensor 670 and to the output of the current sensor 620 respectively.

In operation, the PWM generator 650 generates a first PWM signal (PWM) with the desired duty cycle and a second PWM signal (PWM'). The PWM generator 650 receives a first signal to set the duty cycle of PWM and a second signal to set a time window during which PWM' is high (logic 1) and PWM is low (logic 0). This time window may be varied depending on the application. For instance the time window may be 1% of the first PWM signal. Digital control logic may be used to identify the duty cycle and to generate different PWM' and PWM signals for different duty cycles.

The state (open or closed) of the feedback switch 680 is controlled either by the first PWM signal (PWM) or by the second PWM signal (PWM'). The state of the PWM dimmer switch 660 is controlled by the second PWM signal (PWM'). The circuit 600 operates in a plurality of phases depending on the state of PWM and PMW'.

When PWM is low (logic 0) and PWM' is high (logic 1) the dimmer switch 660 couples the gate terminal of transistor 610 to the output of the differential amplifier 630. The feedback switch 680 couples the inverting input of the differential amplifier 630 to the voltage sensor 670. The differential amplifier 630 provides a voltage proportional to the difference between the current at the output of the voltage sensor 670 and the reference current at the non-inverting input. The reference current may be the target current or another current different from the target current. In this case the sensor 670 would be configured to adjust the feedback ratio accordingly. In this phase the circuit monitors a variation of the gate voltage and holds the gate of transistor 610 to a predetermined voltage.

When PWM and PWM' are both high (logic 1), the feedback switch 680 couples the inverting input of the differential amplifier 630 to the current sensor 620. The gate voltage rises above Vth and the ILED current rises to its target value ILED_target. When the gate voltage is above the threshold voltage Vth of the transistor 610, a current Iled passes through the string of LEDs 640 which emits light.

Figure 7:
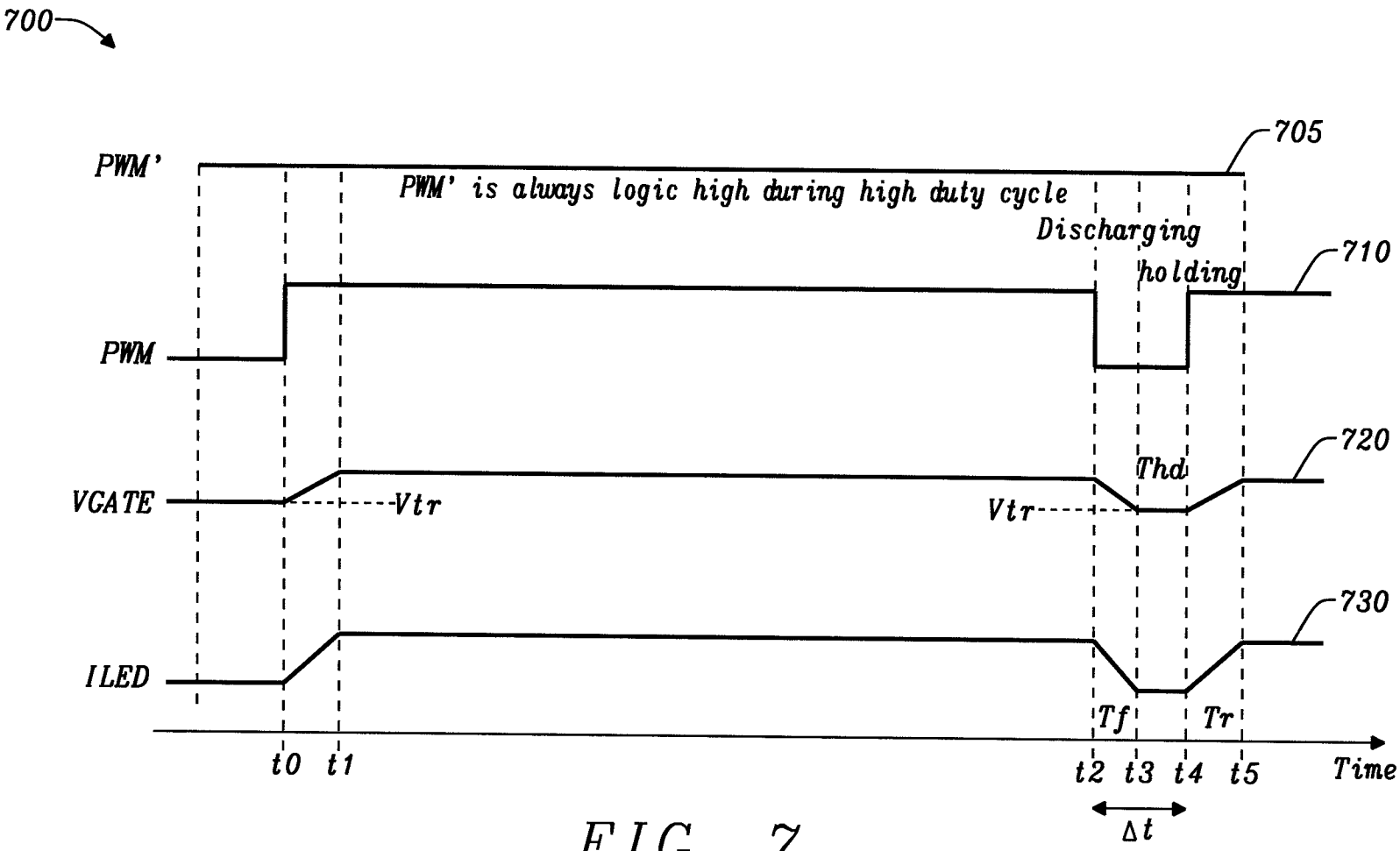
FIG. 7 is a waveform diagram illustrating the working of the dimmer of FIG. 6 when the PWM signal is set with a high duty cycle.

FIG. 7 is a waveform diagram 700, illustrating the working of the dimmer circuit of FIG. 6 when implementing the discharging-holding method. FIG. 7 shows the PWM' signal 705, the PWM signal 710, the gate voltage 720 and the LED current 730. The PWM signal 710 has a duty cycle greater than 50% and is used to achieve a relatively low level of dimming.

Before time t0, the PWM signal 710 is in a low state (logic 0) and the PWM' signal 705 is high (logic 1). The gate voltage 720 is at a pre-determined voltage Vtr, and the LED current 730 is null. At time t0 the PWM' signal 705 remains high and the PWM signal 710 transits from logic low to logic high. In this example the predetermined voltage Vtr is chosen very close or equal to Vth, so when the PWM signal turns high the gate voltage 720 and the LED current 730 both start increasing linearly. At time t1 the gate voltage 720 reaches the value set by the differential amplifier and the LED current 730 reaches a target value. At time t2 the PWM signal 710 transits from logic high to logic low while the PWM' signal 705 remains high. The gate voltage 720 and the LED current start 730 start decreasing linearly. At time t3, the gate voltage 720 reaches the pre-determined voltage Vtr and the LED current 730 is null. The voltage Vtr may be detected by measuring the LED current when ramping VGATE.

Between the times t3 and t4 the gate voltage 720 is held at the pre-determined voltage Vtr. At time t4 the PWM signal 710 transits from logic low to logic high. The gate voltage starts increasing from Vtr and the LED current start increasing linearly. As a result there is no turn-on delay. Since the gate voltage 720 is not grounded it takes less time for the gate to reach the desired gate voltage once the PWM signal 710 is turned on.

In summary between the times t0 and t2, the system operates in a PWM ON phase during which PWM' 705 and PWM 710 are both high. Between the times t2 and t4 the system operates in the so-called discharge and hold phase during which the PWM signal 710 is low (logic 0) and the PWM' signal is high (logic1). The time window Δt between the times t2 and t4 may vary depending on the application. For example Δt may be set to 1% of the PWM period, when the PWM OFF time is less than 1%, then there will be no PWM OFF phase during which PWM' and PWM are both low (logic=0). In any case a configuration in which PWM' is low (logic 0) and PWM is high (logic 1) does not occur at any time. The falling time Tf between the times t2 and t3, and the rising time Tr between the times t4 and t5 vary in a same way with PVT. As a result Tf and Tr are balanced.

Figure 8:
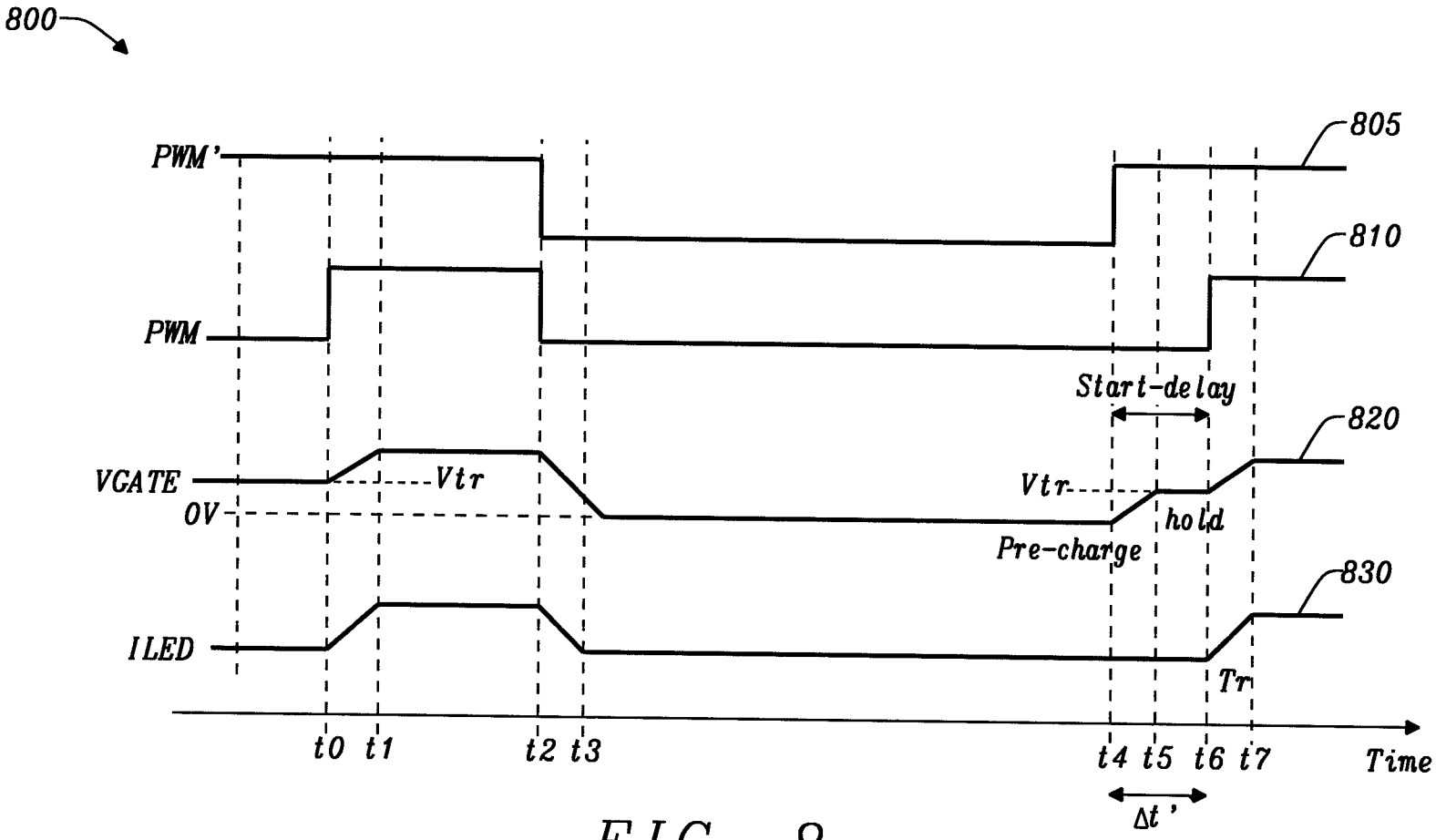
FIG. 8 is a waveform diagram illustrating the working of the dimmer of FIG. 6 when the PWM signal is set with a low duty cycle.

FIG. 8 is 800, a plot illustrating the working of the dimmer circuit of FIG. 6 when implementing the pre-charging-holding method. FIG. 8 shows the PWM' signal 805, the PWM signal 810, the gate voltage 820 and the LED current 830. The PWM signal 810 has a duty cycle less than 50% and is used to achieve a relatively high level of dimming.

Before time t0, the PWM' signal 805 is high (logic 1) and the PWM signal 810 is low (logic 0). The gate voltage 820 is at a pre-determined voltage Vtr, and the LED current 830 is null. At time t0 the PWM signal 810 transits from logic low to logic high. In this example the predetermined voltage Vtr is chosen very close or equal to Vth, so the gate voltage 820 and the LED current 830 both start increasing linearly. At time t1 the gate voltage 820 reaches the value set by the differential amplifier and the LED current 830 reaches a target value. At time t2 the PWM' signal 805 and the PWM signal 810 both transit from logic high to the logic low. The gate voltage 820 and the LED current 830 start decreasing linearly down to ground voltage and zero current respectively.

At time t4, the PWM' signal 805 goes high while PWM 810 remains low. The gate of the regulation transistor starts increasing to reach the pre-determined voltage Vtr at time t5. Between the times t5 and t6 the gate voltage 820 is maintained at Vtr. At time t6 the PWM signal 810 transits from logic low to logic high, while the PWM' signal 805 remains high. The gate voltage 820 and the LED current 830 both start increasing linearly. Since the gate voltage 820 is not grounded but close to Vth it takes less time for the gate to reach the desired gate voltage once the PWM signal is turned on. The time window Δt' between the times t4 and t6 is referred to as the start-delay period. The start-delay period may be a fixed pre-set delay for accurately generating the start-point based on current rising position. The start-delay period includes a pre-charging duration (between the times t4 and t5) and a hold duration (between the times t5 and t6). The pre-charging duration may change depending on PVT variations. The hold duration is used for making sure that the pre-charge duration has ended. The start-delay time window may be chosen to be long enough to cover different PVT conditions. For instance start-delay time may be set to a few hundred of nanoseconds, for example 200 ns or more.

In summary between the times t0 and t2, the system operates in a PWM ON phase during which PWM' 805 and PWM 810 are both high. Between the times t2 and t4 the system operates in a PWM OFF phase during which PWM' and PWM are both low (logic 0). Between the times t4 and t6, the system operates in the so-called pre-charge and hold phase during which the PWM signal 810 is low (logic 0) and the PWM' signal 805 is high (logic1). The time window Δt' between the times t4 and t6 may vary depending on the application. For example the Δt' may be set to 1% of the PWM period. Like in the previous example, a configuration in which PWM' is low (logic 0) and PWM is high (logic 1) does not occur at any time.

A skilled person will appreciate that variations of the disclosed arrangements are possible without departing from the disclosure. Accordingly, the above description of the specific embodiments is made by way of example only and not for the purposes of limitation. It will be clear to the skilled person that minor modifications may be made without significant changes to the operation described.

What is claimed is:

1. A dimmer for dimming light emitted by a light source, the dimmer comprising a regulation switch for regulating a current flowing through the light source;

a regulator circuit adapted to provide an electronic parameter to control the regulation switch;

wherein the regulator circuit comprises a dimmer switch for passing or blocking the electronic parameter; and a signal generator adapted to generate a plurality of modulated signals configured to operate the regulator circuit in a first phase and in a second phase;

wherein in the first phase the regulation circuit maintains the electronic parameter to a target value; and wherein in the second phase the regulation circuit monitors a variation of the electronic parameter and maintains the electronic parameter to a predetermined value.

2. The dimmer as claimed in claim 1, wherein the electronic parameter is a voltage.

3. The dimmer as claimed in claim 2, wherein the predetermined value is a positive voltage that is less or equal to the threshold voltage of the regulation switch.

4. The dimmer as claimed in claim 1, wherein the plurality of modulated signals comprises a first logic signal (PWM') having a first duty cycle and a second logic signal (PWM) having a second duty cycle.

5. The dimmer as claimed in claim 4, wherein when the first logic signal and the second logic signal are both is in a high state, the regulation circuit operates in the first phase.

6. The dimmer as claimed in claim 4, wherein when the first logic signal is in a high state, and the second logic signal is in a low state the regulation circuit operates in the second phase.

7. The dimmer as claimed in claim 4, wherein when the first logic signal and the second logic signal are both in a low state, the regulation circuit operates in a third phase in which no current flows through the light source.

8. The dimmer as claimed in claim 6, wherein when the second duty cycle is greater than a first threshold value; the regulation circuit is adapted to monitor a decrease of the electronic parameter upon transition of the second logic signal from the high state to the low state, and when the electronic parameter has decreased to the pre-determined value, to maintain the electronic parameter at the pre-determined value until the second logic signal turns to the high state.

9. The dimmer as claimed in claim 6, wherein when the second duty cycle is less than a second threshold value; the regulation circuit is adapted to increase the electronic parameter to the pre-determined value while the second logic signal is in the low state, and to maintain the electronic parameter at the pre-determined value until the second logic signal turns to the high state.

10. The dimmer as claimed in claim 9, wherein the electronic parameter is increased at a set time during the low state of the second logic signal.

11. The dimmer as claimed in claim 4, wherein the regulator circuit comprises a differential amplifier coupled to the regulator switch via the dimmer switch.

12. The dimmer as claimed in claim 11, wherein the regulator circuit comprises a first sensor coupled to a control terminal of the regulation switch and a second sensor adapted to sense a current through the light source.

13. The dimmer as claimed in claim 12, wherein the differential amplifier has a first input adapted to receive a reference parameter, and a second input selectively coupled either to the first sensor via a first path or to the second sensor via a second path.

14. The dimmer as claimed in claim 13, wherein the second input is selectively coupled to the first and the second paths via a feedback switch.

15. The dimmer as claimed in claim 14, wherein the dimmer switch is adapted to receive the second logic signal and wherein the feedback switch is adapted to receive both the first logic signal and the second logic signal.

16. A method of dimming light emitted by a light source, the method comprising providing a regulation switch for regulating a current flowing through the light source;

providing a regulator circuit adapted to provide an electronic parameter to control the regulation switch; wherein the regulator circuit comprises a dimmer switch for passing or blocking the electronic parameter;

generating a plurality of modulated signals configured to operate the regulator circuit in a first phase and in a second phase;

wherein in the first phase the regulation circuit maintains the electronic parameter to a target value; and wherein in the second phase the regulation circuit monitors a variation of the electronic parameter and maintains the electronic parameter to a predetermined value.

17. The method as claimed in claim 16, wherein the predetermined value is less than the target value.

18. The method as claimed in claim 17, wherein the predetermined value is a positive voltage that is less or equal to the threshold voltage of the regulation switch.

* * * * *